US008142156B2

(12) United States Patent
Wiegel et al.

(10) Patent No.: US 8,142,156 B2
(45) Date of Patent: Mar. 27, 2012

(54) CEILING FANS WITH LOW SOLIDITY RATIO

(75) Inventors: Aaron J. Wiegel, Benton, WI (US); Daniel M. Anderson, Oak Creek, WI (US); Ronald P. Snyder, Dubuque, IA (US); Donald P. Grant, Dubuque, IA (US); Joseph Korman, Jr., Dubuque, IA (US); Jason Dondlinger, Bellevue, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 863 days.

(21) Appl. No.: 12/228,174

(22) Filed: Aug. 11, 2008

(65) Prior Publication Data

US 2010/0034651 A1 Feb. 11, 2010

(51) Int. Cl.
*B63H 1/06* (2006.01)
*A62C 35/00* (2006.01)

(52) U.S. Cl. ..... 416/143; 169/16; 169/46

(58) Field of Classification Search ..... 416/136, 416/142, 143, 132 R, 132 A, 5, 61; 169/45, 169/46, 51, 52, 16, 37
See application file for complete search history.

(56) References Cited

U.S. PATENT DOCUMENTS

| | | | | |
|---|---|---|---|---|
| 1,361,785 | A | 12/1920 | Tucker | |
| 2,032,616 | A | 3/1936 | Horsky et al. | |
| 3,559,962 | A | 2/1971 | Enssle et al. | |
| 4,776,761 | A * | 10/1988 | Diaz | 416/5 |
| 6,161,994 | A | 12/2000 | Lang | |
| 6,213,716 | B1 | 4/2001 | Bucher et al. | |
| 6,863,498 | B2 * | 3/2005 | Liang | 416/142 |
| 6,928,963 | B2 | 8/2005 | Karanik | |
| 6,991,431 | B2 | 1/2006 | Ching Wen | |
| 7,153,100 | B2 | 12/2006 | Frampton et al. | |
| 7,699,117 | B2 * | 4/2010 | Johnston et al. | 169/43 |
| 2005/0129523 | A1 | 6/2005 | Liu | |
| 2006/0140769 | A1 * | 6/2006 | Frampton et al. | 416/210 R |
| 2007/0036654 | A1 | 2/2007 | Fedeli et al. | |
| 2007/0092376 | A1 * | 4/2007 | Malone et al. | 416/143 |
| 2009/0097975 | A1 * | 4/2009 | Aynsley et al. | 416/32 |

FOREIGN PATENT DOCUMENTS

| | | |
|---|---|---|
| DE | 19841934 | 3/2000 |
| EP | 1473524 | 3/2004 |
| WO | 2007006096 | 1/2007 |

OTHER PUBLICATIONS

Smith (WO2009/111708).*

(Continued)

*Primary Examiner* — Zandra Smith
*Assistant Examiner* — Mark Tornow
(74) *Attorney, Agent, or Firm* — Hanley, Flight & Zimmerman, LLC

(57) ABSTRACT

An overhead fan system of a building comprises a ceiling fan underneath a nearby fire sprinkler head. The ceiling fan has particularly low fan solidity to minimize the fan obstructing the spray of water from the sprinkler head. To further reduce the obstruction, some example fans include fan blades that automatically retract in the event of a fire.

28 Claims, 8 Drawing Sheets

OTHER PUBLICATIONS

International Bureau, "International Preliminary Report on Patentability," issued in connection with international application serial No. PCT/US2009/053173, issued Feb. 15, 2011, mailed Feb. 24, 2011, 10 pages.

International Searching Authority, "International Search Report," issued in connection with corresponding international application serial No. PCT/US2009/053173, mailed Mar. 3, 2010, 5 pages.

International Searching Authority, "Written Opinion of the International Searching Authority," issued in connection with corresponding international application serial No. PCT/US2009/053173, mailed Mar. 3, 2010, 9 pages.

Hunter Fan Company, "Fanaway-48," Model 21425, © 2010, last retrieved from http://www.hunterfan.com/Products/Ceiling-Fans/FANAWAY-21425 on Dec. 15, 2010, 2 pages.

* cited by examiner

CEILING FANS WITH LOW SOLIDITY RATIO

FIELD OF THE DISCLOSURE

This patent generally pertains to ceiling fans and, more specifically, to ceiling fans mounted underneath an overhead fire sprinkler head.

BACKGROUND

Ceiling mounted fans are often used for circulating air within large buildings such as warehouses, factories, gymnasiums, churches, auditoriums, convention centers, theaters, and other buildings with large open areas. For fire safety, a matrix of overhead sprinklers are usually installed to quench fires that might occur within the building. In the event of a fire, the fans preferably are disabled and the sprinklers are turned on.

To detect a fire and control the operation of the fans and sprinklers appropriately, various types of fire sensors are available. They usually operate by optical detection (photoelectric), chemical reaction (ionization), or heat detection (fusible link or infrared sensor for radiation).

Even though a ceiling fan can be de-energized during a fire, various air currents within the building or spray from a nearby sprinkler might keep the fan slowly rotating. Depending on the design of the fan, if the fan blades repeatedly pass underneath and/or come to stop underneath an activated sprinkler head, the fan blades might create interference with the water or other fire-suppressing media spraying from the sprinkler.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

Figure 1:
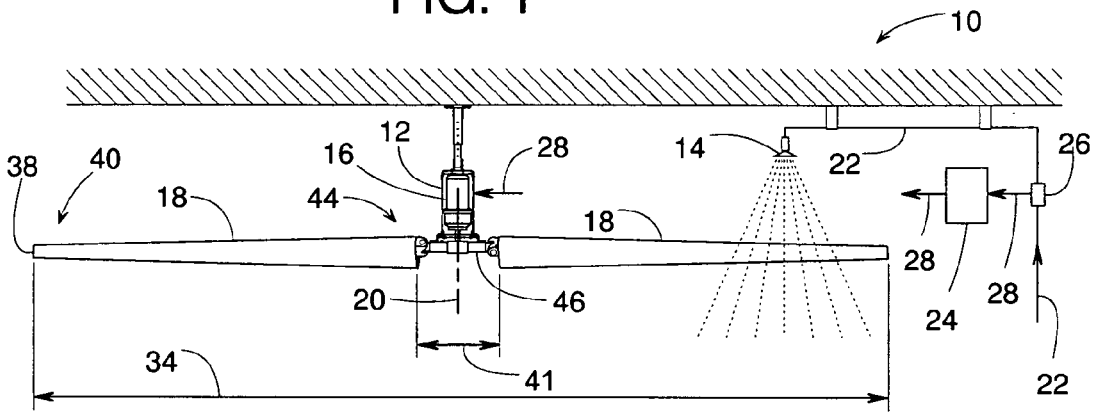
FIG. 1 is a side view of an example overhead fan system.
Figure 2:
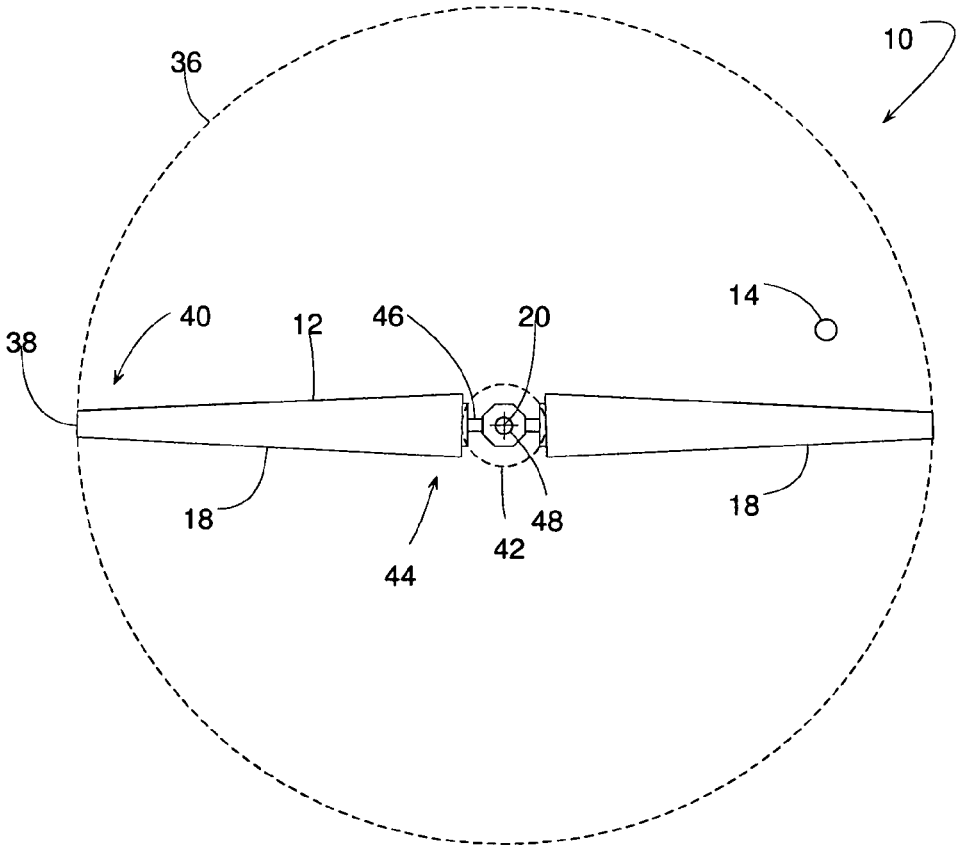
FIG. 2 is a bottom view of FIG. 1.
Figure 3:
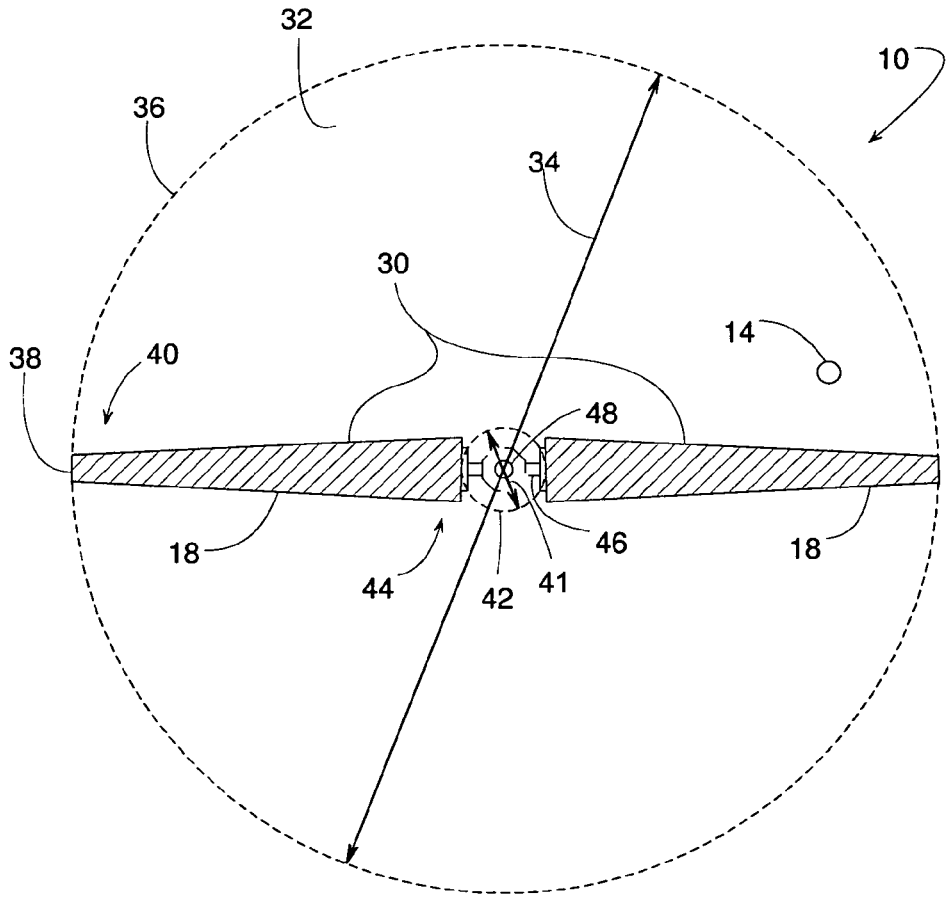
FIG. 3 is a bottom view similar to FIG. 2 but with a certain area crosshatched.

FIGS. 1-3 show an example of a ceiling fan system 10 comprising a ceiling fan 12 for circulating air and an overhead sprinkler 14 for extinguishing a fire. Fan 12 includes a motor 16 that rotates a plurality of fan blades 18 about an axis 20. Fan blades 18 are of a size and quantity that provides fan 12 with particularly low fan solidity so that, in the event of a fire, fan 12 poses a minimal obstruction to sprinkler 14. Sprinkler 14 is in proximity with fan 12, which means that fan 12 is sufficiently close to sprinkler 14 that fluid spray from sprinkler 14 could reach fan 12.

The term, "fire" used herein refers to any burning event or state of combustion including, but not limited to, an open flame and flameless smoldering.

Upon sensing a characteristic associated with a fire, a sensor triggers the operation of sprinkler 14 so that sprinkler 14 sprays a fire-extinguishing fluid (e.g., water) from a supply line 22 onto the fire. Examples of a characteristic associated with a fire include, but are not limited to, heat, smoke, and light. In some examples, an optical or ionization detector senses smoke and activates a solenoid valve that supplies water to sprinkler 14. In another example, a fusible link on a valve portion of sprinkler 14 melts in the presence of heat to activate sprinkler 14. Sprinkler 14 is schematically illustrated to represent the aforementioned examples as well as other sprinkler-activating methods commonly known to those of ordinary skill in the art.

In addition to activating sprinkler 14 in the event of a fire, fan 12 preferably is de-energized or turned off automatically so as not to aerate the fire or significantly interfere with the spray pattern of sprinkler 14. To automatically turn off fan 12 in the presence of a fire, some examples of ceiling fan system 10 include a control system 24 responsive to a characteristic associated with the fire, wherein control system 24 is operatively connected in communication with sprinkler 14 and fan 12. In some examples, control system 24 includes a water flow sensor 26 in supply line 22, thereby connecting control system 24 in communication with sprinkler 14. When sprinkler 14 is open, sensor 26 provides a signal 28 upon sensing water flowing through supply line 22 to sprinkler 14. In this example, water flowing through supply line 22 is the characteristic associated with a fire. Control system 24 can relay or convey signal 28 to motor 16 to deactivate fan 12, thus control system 24 is connected in communication with fan 12 as well as with sprinkler 14 to coordinate the operation of both.

Even though fan 12 is turned off while sprinkler 14 is spraying water, to further minimize the fan's potential interference with the operation of sprinkler 14, fan 12 has particularly low fan solidity, as mentioned earlier. Fan solidity is defined herein as a solidity ratio times a diameter adjustment factor. Solidity ratio is defined as a cumulative blade projection area 30 obstructed by fan blades 18 (as viewed in a direction parallel to axis 20) divided by a total circular area 32 within an outer diameter 34 of fan 12. The cumulative blade projection area 30 is the crosshatched area of FIG. 3. Outer diameter 34 is defined by a circular path 36 traced by a tip 38 of a distal end 40 of the longest fan blade 18 as fan blades 18 rotate about axis 20. Although sprinkler 14 is shown to be within outer diameter 34, sprinkler 14 could also be just beyond outer diameter 34 and still be considered in proximity with fan 12.

A fan with extremely long fan blades would naturally have a low solidity ratio, yet such a long-bladed fan would have an exceptionally large outer diameter, thereby still creating a large area of potential interference with a sprinkler, due to such a fan's "long reach." Thus, to account for the negative effect of a fan's overall outer diameter, the solidity ratio is multiplied by a diameter adjustment factor to determine the fan solidity. The diameter adjustment factor is defined herein as fan blade 18 outer diameter 34 divided by a fan blade inner diameter 41. The fan blade 18 inner diameter 41 is the diameter of a circular path 42 traced by a proximal end 44 of the longest fan blade 18 when fan 12 is turned on. Proximal end 44 and distal end 40 are at opposite ends of fan blade 18. Proximal end 44 is where the airfoil portion of the fan blade 18 terminates, thus proximal end 44 is not part of a mechanical coupling 46 that connects fan blade 18 to a rotor shaft 48 of motor 16.

For ample fan airflow with minimal obstruction to sprinkler 14, fan 12 has a fan solidity of less than 0.7 and preferably between 0.4 and 0.6. This can be achieved with a two-blade fan with a solidity ratio of less than 0.2 and a diameter adjustment factor of 2 to 20. Fan solidity, solidity ratio and the diameter adjustment factor are each dimensionless values.

Figure 4:
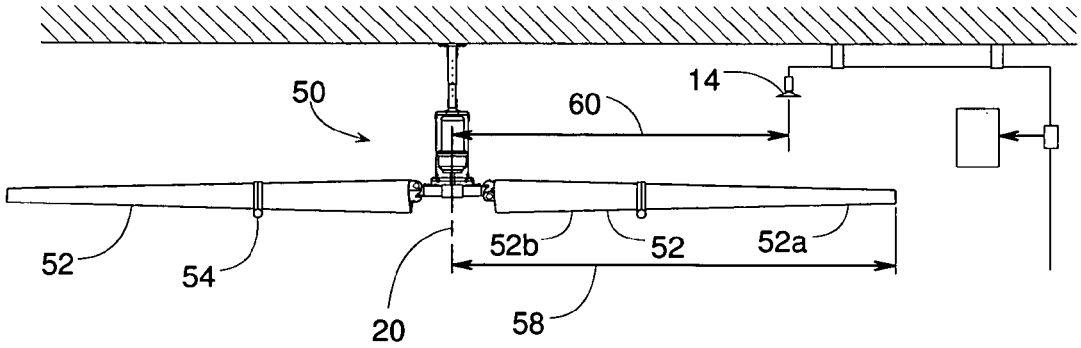
FIG. 4 is a side view of another example overhead fan system.
Figure 5A:
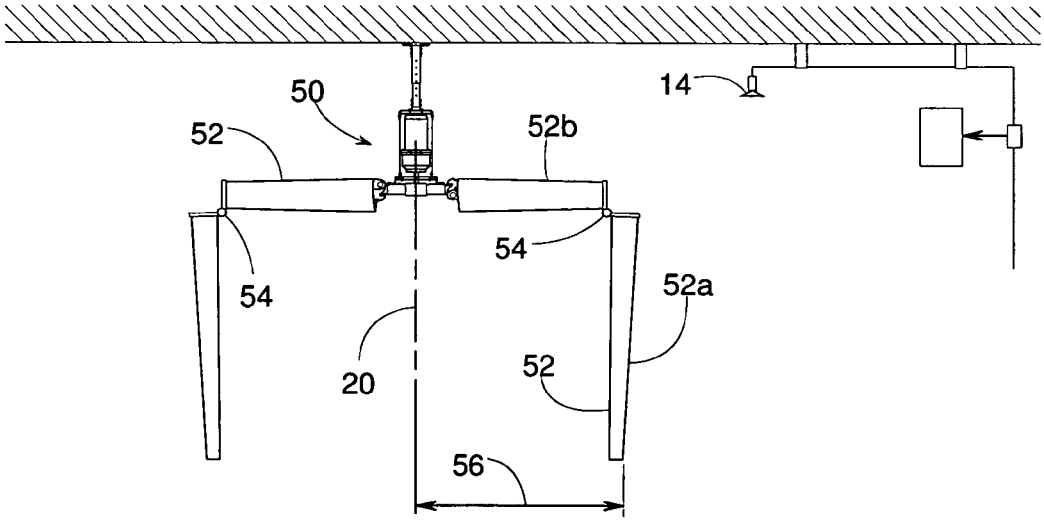
FIG. 5A is a side view similar to FIG. 4 but showing the fan blades retracted.

Ample airflow and minimal obstruction to sprinkler 14 can also be achieved with a fan that automatically retracts its fan blades when the fan turns off. FIGS. 4 and 5A, for example, show a ceiling fan 50 with retractable fan blades 52. Each fan blade 52 is comprised of a distal end 52*a* pivotally coupled to a proximal end 52*b* by way of a hinge 54. The hinge 54 is, thus, located at a central location along the length of the fan blade (e.g., near a midpoint of the blade). When fan 50 is turned off, distal end 52*a* hangs pendant at a first radial distance 56 from the motor's rotational axis 20. When fan 50 turns on, centrifugal and aerodynamic forces urge distal end 52*a* up and outward to a second radial distance 58 from axis 20.

If sprinkler 14 is at an intermediate radial distance 60 between the points defined by radial distances 56 and 58, and fan 50 turns off when sprinkler 14 operates, then fan 50 being off provides minimal if any obstruction to sprinkler 14, since distal end 52*a* is substantially clear of and avoids sprinkler 14 when distal end 52*a* is hanging pendant. Coordinating the operation of sprinkler 14 and fan 50, e.g., automatically turning fan 50 off when sprinkler 14 operates, can be achieved in the same manner as described with reference to ceiling fan system 10 of FIGS. 1-3. The fan blades could alternatively hand pendant from their inner portions (i.e., the entire blade could hang pendant and the hinges could be eliminated). The example of FIG. 5A is advantageous over such an approach, however, in that only a distal portion of the blades hang pendant, thus, keeping the lowest portion of the fan blades at a higher position (and creating more head room) when in the pendant position than an approach that omits the hinged blade and instead pivots the entire blade to a pendant position).

Figure 5B:
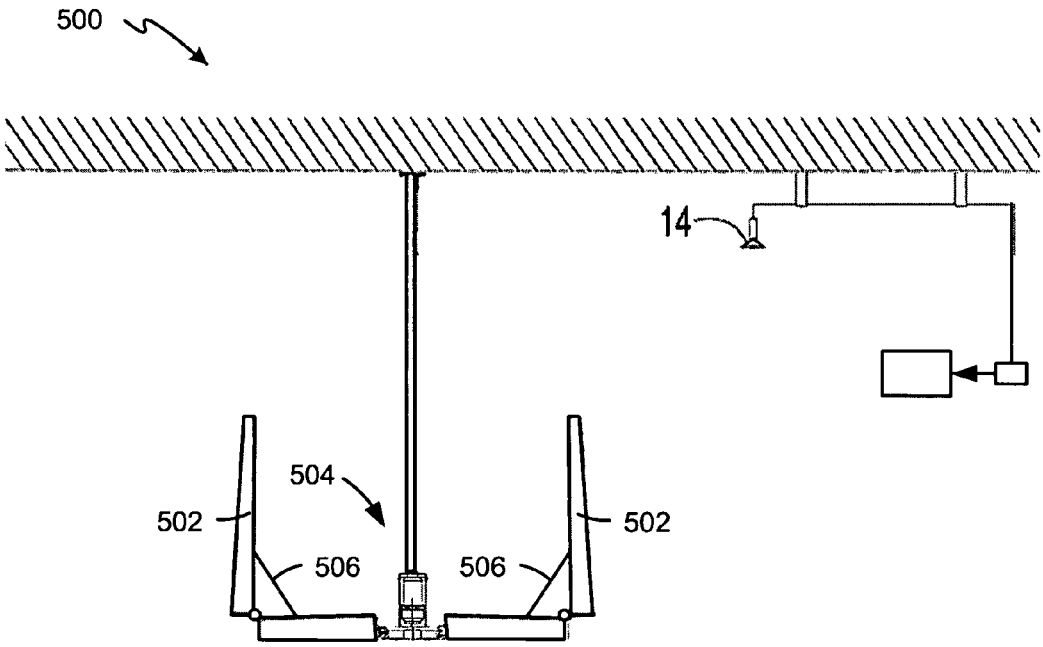
FIG. 5B is an alternative configuration showing the fan blades retracted.

Although distal ends 52*a* swing downward upon de-energizing fan 50 in FIG. 5A, in the example ceiling fan system 500 of FIG. 5B, the distal ends 502 are hinged so as to swing upward. Specifically, the fan 504 is provided with a plurality of biasing elements 506 to urge distal ends 502 upward when the fan 504 turns off. Examples of such upward biasing elements include, but are not limited to, a spring or counterweight that urges the corresponding distal end 502 upward.

Figure 6:
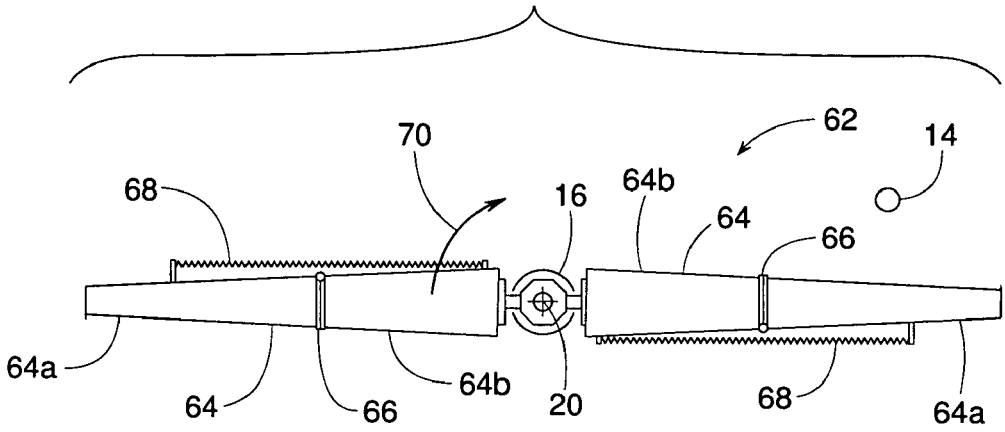
FIG. 6 is a bottom view of another example overhead fan system.
Figure 7:
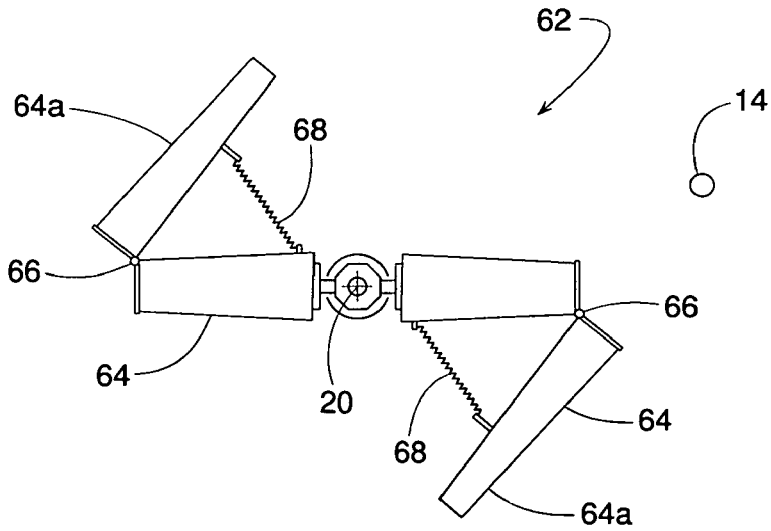
FIG. 7 is a bottom view similar to FIG. 6 but showing the fan blades retracted.

In another example, shown in FIGS. 6 and 7, a ceiling fan 62 includes a plurality of fan blades 64, wherein each fan blade 64 is comprised of a distal end 64*a* pivotally connected to a proximal end 64*b* by way of a hinge 66. In this example, hinge 66 allows distal end 64*a* to retract by pivoting generally horizontally toward axis 20. When fan 62 turns off, a tension spring 68 (e.g., an elastic cord) and/or rotational deceleration of distal end 64*a* urges distal end 64*a* to the retracted position of FIG. 7. When fan 62 turns on and begins rotating in the direction indicated by arrow 70, centrifugal force, rotational acceleration and aerodynamic forces overcome the force of spring 68 to urge distal end 64*a* back out to its extended position of FIG. 6. Thus, fan blades 64 are fully extended and operational underneath sprinkler 14 when fan 62 is turned on, and fan blades 64 are clear of and purposely avoid sprinkler 14 when fan 62 is turned off.

Figure 8:
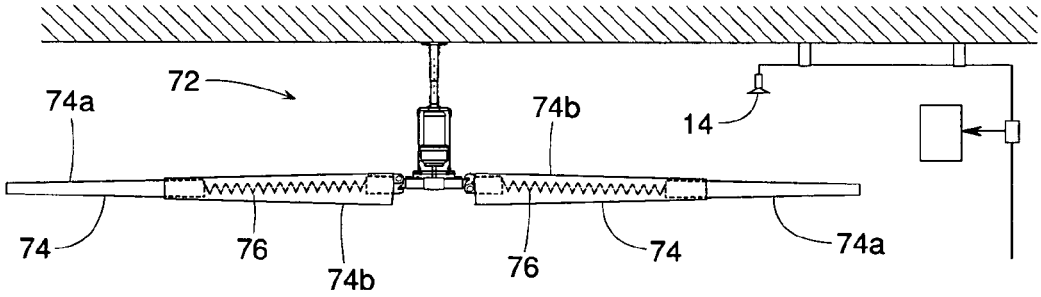
FIG. 8 is a side view of yet another example of an overhead fan system.
Figure 9:
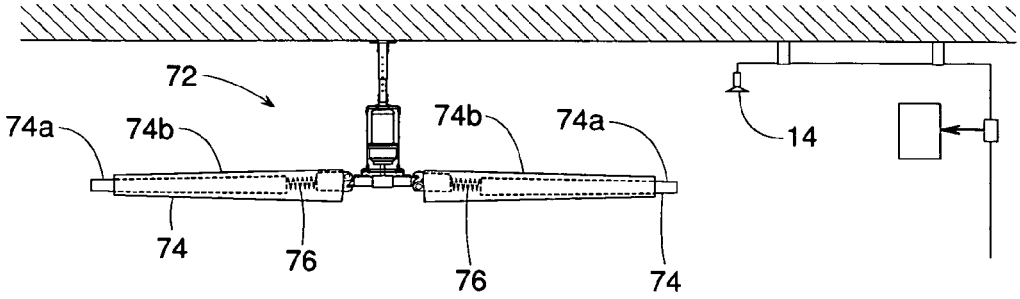
FIG. 9 is a side view similar to FIG. 8 but showing the fan blades retracted.

In yet another example, shown in FIGS. 8 and 9, a ceiling fan 72 includes a plurality of fan blades 74, wherein each fan blade 74 is comprised of a distal end 74*a* telescopically connected to a proximal end 74*b*. The telescopic connection between ends 74*a* and 74*b* allow distal end 74*a* to retract by sliding into a hollow interior of proximal end 74*b*. When fan 72 turns off, a tension spring 76 draws distal end 74*a* into proximal end 74*b* so that distal end 74*a* moves from an extended position (FIG. 8) to a retracted position (FIG. 9). When fan 72 turns on, centrifugal force overcomes the force of spring 76 to urge distal end 74*a* from its retracted position of FIG. 9 to its extended position of FIG. 8. Thus, fan blades 74 are fully extended and operational underneath sprinkler 14 when fan 72 is turned on, and fan blades 74 are clear of and avoid sprinkler 14 when fan 72 is turned off.

Having fan blades comprised of a distal end coupled to a proximal end, as shown in FIGS. 4-9, can provide a significant benefit to the manufacturer and/or supplier of such fans. Such fans can be offered to end users as a standard base unit with fan blades each having a common proximal end to which distal ends of various length can be added selectively to create various diameter fans. A base unit fan, for instance, could be an 8-foot diameter fan with 3-foot long proximal end fan blades (i.e., 8-foot outer diameter and 2-foot inner diameter). To such a base unit, 3-foot long distal ends can be added to create a 14-foot diameter fan, or 5-foot long distal ends could instead be added to create an 18-foot diameter fan using the same 8-foot diameter base unit. In the case where no additional distal end is added to the standard 8-foot diameter base unit, then the outer tip of the proximal end is considered the distal end of an 8-foot diameter fan.

Figure 10:
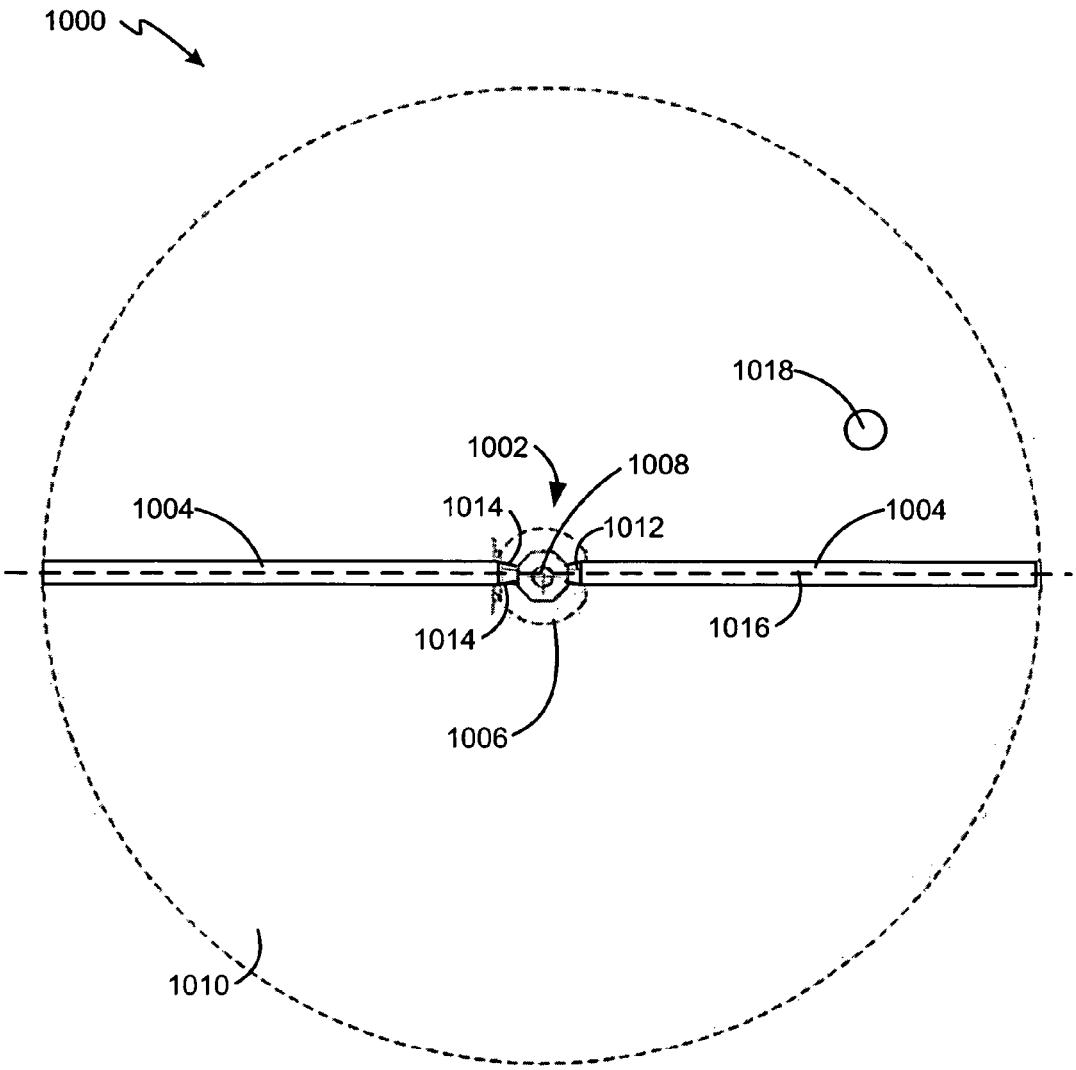
FIG. 10 is a top view on an alternative configuration of an example overhead fan system.

FIG. 10 depicts an alternative ceiling fan system 1000 that includes a fan 1002 having a plurality of fan blades 1004 that are disposed in a rest position (e.g., a position in which the fan blades 1004 are not rotating in a circular path 1006 about an axis 1008). Specifically, in the illustrated example, the fan blades 1004 are rotationally coupled to a mechanical coupling 1012 that enables the fan blades 1004 to rotate about their longitudinal axes toward a non-use position in which the fan blades 1004 are oriented at substantially 90 degrees to a horizontal plane (e.g., the ground surface) when the fan 1002 is turned off. In particular, the fan 1002 may be provided with a plurality of biasing elements 1014. Each of the biasing elements 1014 is assigned to a corresponding one of the fan blades 1004. Each biasing element 1014 urges its corresponding fan blade 1004 to rotate about a longitudinal axis 1016 of the fan blade 1004 toward the non-use position when the fan 1002 is turned off. Positioning the fan blades 1004 in this non-use position ensures that the major surface of each fan blade 1004 is disposed in a generally vertical plane and the edge of each fan blade 1004 is pointed upward to purposely decrease the cross-sectional area of the fan blades 1004 presented between the sprinkler 1018 and a ground surface, thereby reducing interference with sprinkler 1018 operation. When the fan 1002 is turned on, centrifugal and aerodynamic forces over come the force from the plurality of biasing elements 1014 and urge the fan blades 1004 into the use position (e.g., in a substantially horizontal plane 1010 which is substantially parallel to a ground surface). In the above example, it is assumed that the fan 1002 is mounted such that the fan blades 1004 are intended to rotate in a generally horizontal plane parallel to, for example a floor. In some instances, a pitch of the fan blade 1004 may change over a length of the fan blade 1004 (e.g., there may be inconsistencies in the shape of the fan blade 1004 and/or the fan blade 1004 might not be flat relative to the ground). In examples where the fan 1002 is mounted at an angle, the principle of operation would be the same (i.e., the fan blades 1004 would rotate about their longitudinal axes to reduce interference with overhead sprinklers 1018, but the plane of operation of the fan blades 1004 might not be parallel to the ground).

Figure 11:
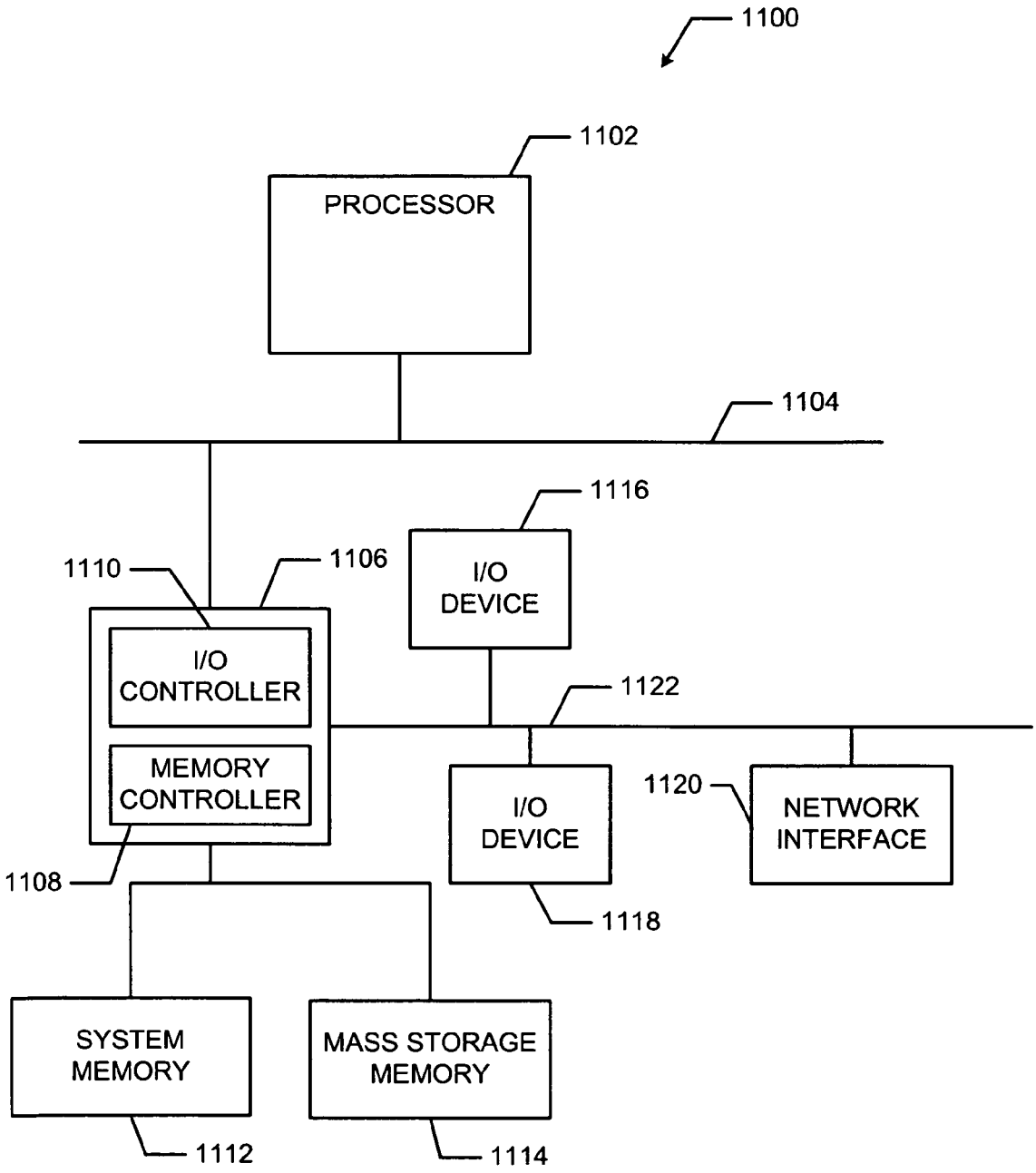
FIG. 11 illustrates an example manner of implementing the controller of FIG. 1.

FIG. 11 is a block diagram of an example processor system 1100 that may be used to implement the example control system 24 of FIG. 1. As shown in FIG. 11, the processor system 1100 includes a processor 1102 that is coupled to an interconnection bus 1104. The processor 1102 may be any suitable processor, processing unit or microprocessor. Although not shown in FIG. 11, the processor system 1100 may be a multi-processor system and, thus, may include one or more additional processors that are identical or similar to the processor 1102 and that are communicatively coupled to the interconnection bus 1104.

The processor 1102 of FIG. 11 is coupled to a chipset 1106, which includes a memory controller 1108 and an input/output (I/O) controller 1110. The chipset provides I/O and memory management functions as well as a plurality of general purpose and/or special purpose registers, timers, etc. that are accessible or used by one or more processors 1102 coupled to the chipset 1106. The memory controller 1108 performs functions that enable the processor 1102 (or processors if there are multiple processors) to access a system memory 1112 and a mass storage memory 1114, if present.

The system memory 1112 may include any desired type of volatile and/or non-volatile memory such as, for example, static random access memory (SRAM), dynamic random access memory (DRAM), flash memory, read-only memory (ROM), etc. The mass storage memory 1114 may include any desired type of mass storage device including hard disk drives, optical drives, tape storage devices, etc.

The I/O controller 1110 performs functions that enable the processor 1102 to communicate with peripheral input/output (I/O) devices 1116 and 1118 and a network interface 1120 via an I/O bus 1122. The I/O devices 1116 and 1118 may be any desired type of I/O device such as, for example, a keyboard, a video display or monitor, a mouse, etc. The network interface 1120 may be, for example, an Ethernet device, an asynchronous transfer mode (ATM) device, an 802.11 device, a DSL modem, a cable modem, a cellular modem, etc. that enables the processor system 1100 to communicate with another processor system.

While the memory controller 1108 and the I/O controller 1110 are depicted in FIG. 11 as separate functional blocks within the chipset 1106, the functions performed by these blocks may be integrated within a single semiconductor circuit or may be implemented using two or more separate integrated circuits.

At least some of the aforementioned examples include one or more features and/or benefits including, but not limited to, the following:

In some examples, a ceiling fan minimizes interference with an overhead sprinkler head by virtue of the ceiling fan having a particularly low solidity ratio.

In some examples, a ceiling fan minimizes interference with an overhead sprinkler head by virtue of the ceiling fan having a particularly low fan solidity (solidity ratio times a diameter adjustment factor).

In some examples, a ceiling fan minimizes interference with an overhead sprinkler head by virtue of the ceiling fan having only two fan blades.

In some examples, a ceiling fan minimizes interference with an overhead sprinkler head by having the fan blades automatically retract in the event of a fire.

In some examples, a ceiling fan minimizes interference with an overhead sprinkler head by having the fan blades automatically retract in coordination with the activation of the sprinkler head.

In some examples, the fan blades of a ceiling fan sweep a circular path underneath an overhead sprinkler head when the fan is turned on and the sprinkler is off, and the fan blades automatically retract out from underneath the sprinkler head when the fan turns off and the sprinkler is on.

In some examples, a ceiling fan is comprised of a standard base unit with fan blades each having a common proximal end to which distal ends of various length can be added selectively to create various diameter fans.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. An overhead fan system including an overhead fan, the overhead fan system comprising:

a motor; and a plurality of fan blades extending radially outward from the motor and being rotatable thereby to define a fan blade outer diameter, a fan blade inner diameter, and a cumulative blade projection area, the plurality of fan blades rotatable about their longitudinal axes between an operational position and a non-use position, the longitudinal axes extending from proximal ends to distal ends of the fan blades, wherein the cumulative blade projection area is an area obstructed by the plurality of fan blades as viewed in a direction parallel to an axis about which the plurality of fan blades are rotated by the motor, the overhead fan has a fan solidity defined as a solidity ratio times a diameter adjustment factor, the solidity ratio is the cumulative blade projection area divided by a circular area defined by the fan blade outer diameter, the diameter adjustment factor is the fan blade outer diameter divided by the fan blade inner diameter, the fan solidity is a dimensionless value of less than 0.7.

2. The overhead fan system of claim 1, wherein the fan solidity is between 0.4 and 0.6.

3. The overhead fan system of claim 1, wherein the solidity ratio is less than 0.2, and the solidity ratio is a second dimensionless value.

4. The overhead fan system of claim 1, wherein the diameter adjustment factor is between 2 and 20, and the diameter adjustment factor is a second dimensionless value.

5. The overhead fan system of claim 1, further comprising an overhead sprinkler head disposed in proximity with the overhead fan.

6. The overhead fan system of claim 5, wherein the overhead sprinkler head is above the plurality of fan blades and is displaced radially from the axis at a distance of less than half the fan blade outer diameter.

7. The overhead fan system of claim 5, wherein the overhead fan system is responsive to a characteristic associated with a fire, the overhead fan system further comprising:

a control system responsive to the characteristic associated with the fire, both the overhead sprinkler head and the overhead fan are operatively connected in communication with the control system so as to coordinate operation of the overhead fan and the overhead sprinkler head should the fire occur.

8. The overhead fan system of claim 1, wherein the plurality of fan blades includes less than three fan blades.

9. The overhead fan system of claim 1, wherein the plurality of fan blades are rotationally coupled to the motor.

10. The overhead fan system of claim 9, further comprising at least one biasing element to urge the fan blades to rotate about their longitudinal axes when the fan is stopped.

11. An overhead fan system including an overhead fan, the overhead fan system, comprising:

a motor;

a plurality of fan blades extending radially outward from the motor and being rotatable by the motor about an axis to define a fan blade outer diameter, each of the fan blades comprises a first portion and a second portion coupled together so that the second portion includes nearly all of a radially outward extension of the fan blade when the motor is not operating, the first portion being movable relative to the second portion; and an overhead sprinkler head disposed above the plurality of fan blades and being displaced radially from the axis at a distance of less than half the fan blade outer diameter.

12. The overhead fan system of claim 11, wherein the overhead fan system is responsive to a characteristic associated with a fire, the overhead fan system further comprising:

a control system responsive to the characteristic associated with the fire, both the overhead sprinkler head and the overhead fan are operatively connected in communication with the control system so as to coordinate operation of the overhead fan and the overhead sprinkler head should the fire occur.

13. The overhead fan system of claim 11, wherein the first portion is pivotably coupled to the second portion.

14. The overhead fan system of claim 11, wherein the first portion is telescopically coupled to the second portion.

15. The overhead fan system of claim 11, wherein the plurality of fan blades extending radially outward from the motor and being rotatable thereby also defines a fan blade inner diameter and a cumulative blade projection area, wherein the cumulative blade projection area is an area obstructed by the plurality of fan blades as viewed in a direction parallel to the axis about which the plurality of fan blades are rotated by the motor, the overhead fan has a fan solidity defined as a solidity ratio times a diameter adjustment factor, the solidity ratio is the cumulative blade projection area divided by a circular area defined by the fan blade outer diameter, the diameter adjustment factor is the fan blade outer diameter divided by the fan blade inner diameter, the fan solidity is a dimensionless value of less than 0.7.

16. The overhead fan system of claim 15, wherein the fan solidity is between 0.4 and 0.6.

17. The overhead fan system of claim 15, wherein the solidity ratio is less than 0.2, and the solidity ratio is a second dimensionless value.

18. The overhead fan system of claim 15, wherein the diameter adjustment factor is between 2 and 20, and the diameter adjustment factor is a second dimensionless value.

19. An overhead fan system including an overhead fan that can be turned on and off, the overhead fan system, comprising:

a motor;

a fan blade coupled to the motor such that when the overhead fan is turned on, the motor rotates the fan blade about a rotational axis of the motor, the fan blade comprises a first portion and a second portion, the first portion having a distal end that is at a first radial distance from the rotational axis and is at a first position relative to the second portion when the overhead fan is turned off and is at a second radial distance from the rotational axis and is at a second position relative to the second portion when the overhead fan is turned on, wherein the second portion includes nearly all of a radially outward extension of the fan blade when the motor is turned off; and a sprinkler head above the fan blade and being radially offset from the rotational axis at an intermediated radial distance that is between the first radial distance and the second radial distance.

20. The overhead fan system of claim 19, wherein the second portion includes a proximal end that couples the first portion to the motor, the first portion being pivotally coupled to the second portion such that the first portion pivots downward when the fan turns off.

21. The overhead fan system of claim 19, wherein the second portion includes a proximal end that couples the first portion to the motor, the first portion is pivotally coupled to the second portion such that the first portion pivots upward when the fan turns off.

22. The overhead fan system of claim 19, wherein the second portion includes a proximal end that couples the first portion to the motor, the first portion is pivotally coupled to the second portion such that the first portion pivots horizontally when the fan turns off.

23. The overhead fan system of claim 19, wherein the first portion translates in a telescopic manner relative to the second portion from the second radial distance to the first radial distance when the fan turns off.

24. An overhead fan method that involves an overhead fan that can be turned on and off and a sensor that can provide a signal in an event of a fire, the overhead fan includes a plurality of fan blades that can be retracted from an extended position to a retracted position, the method comprising:

in the event of the fire, providing the signal via the sensor; and moving a first portion of a fan blade relative to a second portion of the fan blade in response to the signal to retract the fan blade, wherein the second portion includes nearly all of a radially outward extension of the fan blade when the fan blade is retracted.

25. The method of claim 24, further comprising:

in response to the signal, turning the overhead fan off, thereby decelerating the plurality of fan blades; and retracting the fan blades upon decelerating the plurality of fan blades.

26. The method of claim 24, wherein the sensor is associated with a sprinkler head that is above the plurality of fan blades.

27. The method of claim 24, wherein retracting the plurality of fan blades involves pivoting the plurality of fan blades.

28. The method of claim 24, wherein retracting the plurality of fan blades involves telescopically moving the plurality of fan blades toward an axis about which the plurality of fan blades rotate when the fan is turned on.

* * * * *